US007392794B2

(12) United States Patent
Hazama

(10) Patent No.: US 7,392,794 B2
(45) Date of Patent: Jul. 1, 2008

(54) FLUID APPARATUS HAVING PUMPS AND METHOD FOR CONTROLLING THE SAME

(75) Inventor: Tadashi Hazama, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/714,808

(22) Filed: Mar. 7, 2007

(65) Prior Publication Data

US 2007/0221173 A1 Sep. 27, 2007

(30) Foreign Application Priority Data

Mar. 23, 2006 (JP) ..... 2006-080127

(51) Int. Cl.
*F02M 37/08* (2006.01)
*F02M 37/04* (2006.01)

(52) U.S. Cl. ..... 123/497; 123/456

(58) Field of Classification Search ..... 123/497, 123/495, 457, 458, 459, 510, 456
See application file for complete search history.

(56) References Cited

U.S. PATENT DOCUMENTS 4,274,380 A * 6/1981 de Vulpillieres ..... 123/456
5,878,724 A * 3/1999 Channing ..... 123/514
6,536,415 B2 * 3/2003 Joos et al. ..... 123/497
6,889,656 B1 * 5/2005 Rembold et al. ..... 123/446
6,889,666 B2 * 5/2005 Oono ..... 123/514
6,971,373 B2 * 12/2005 Mudway et al. ..... 123/497
2002/0069856 A1 * 6/2002 Mayer et al. ..... 123/510
2002/0162536 A1 * 11/2002 Steinbrenner et al. ..... 123/446
2005/0061297 A1 * 3/2005 Oono ..... 123/458
2005/0188958 A1 * 9/2005 Klenk et al. ..... 123/458

FOREIGN PATENT DOCUMENTS

JP 05-39763 2/1993
JP 07-293397 11/1995
JP 2003-293883 10/2003

* cited by examiner

*Primary Examiner*—Mahmoud Gimie
(74) *Attorney, Agent, or Firm*—Nixon & Vanderhye PC

(57) ABSTRACT

A fluid apparatus, which is provided for supplying fluid into an internal combustion engine, includes an upstream pump, which is electrically driven, having an outlet port. The fluid apparatus further includes a downstream pump, which is electrically driven, having an inlet port that is connected with the outlet port in series. The fluid apparatus further includes an open-close unit. The open-close unit communicates a fluid passage through which the upstream pump supplies fluid to the internal combustion engine when the downstream pomp stops. The open-close unit blocks the fluid passage when the downstream pomp operates.

10 Claims, 3 Drawing Sheets

FLUID APPARATUS HAVING PUMPS AND METHOD FOR CONTROLLING THE SAME

CROSS REFERENCE TO RELATED APPLICATIONS

This application is based on and incorporates herein by reference Japanese Patent Application No. 2006-80127 filed on Mar. 23, 2006.

FIELD OF THE INVENTION

The present invention relates to a fluid apparatus having pumps connected in series. The present invention further relates to a method for controlling the fluid apparatus.

BACKGROUND OF THE INVENTION

JP-A-5-39763 discloses a pressure regulator for controlling pressure of fuel supplied to fuel injection valves. The pressure regulator has a spring chamber serving as a back pressure chamber. In this structure, set pressure of the pressure regulator is controlled by switching pressure in the spring chamber to either air intake pressure or the atmospheric pressure.

According to JP-A-7-293397, voltage applied to the fuel pump is controlled in accordance with the difference between target pressure and detection pressure, which indicates pressure of fuel supplied to the fuel injection valves.

In JP-A-5-39763, the controllable pressure range of the pressure regulator is narrow within the difference between the atmospheric pressure and the maximum negative pressure in the air intake pipe. Accordingly, the load applied to the fuel pump does not largely change. Consequently, change in the electricity consumption of the fuel pump is small, and the fuel pump may consume a large amount of electricity in an operating condition where the engine does not require high pressure fuel.

According to JP-A-7-293397, voltage applied to the fuel pump is controlled in accordance with the difference between the detection pressure and the target pressure, so that power consumption of the fuel pump changes in accordance with the operating condition of the engine. Thus, power consumption of the fuel pump can be reduced.

However, in general, an electric fuel pump is designed to produce optimum efficiency when the fuel pump is applied with the maximum voltage. Therefore, when the voltage applied to the fuel pump decreases, the efficiency of the fuel pump decreases. The efficiency $\eta$ of the fuel pump is defined by: $\eta=(P\times Q)/(I\times V)$. Here, driving current supplied to an electric motor of the fuel pump is I. Voltage applied to the electric motor of the fuel pump is V. Discharge pressure of the fuel pump is P. A discharge amount of the fuel pump is Q. In JP-A-7-293397, the voltage applied to the fuel pump is controlled in accordance with the difference between the detection pressure and the target pressure, so that the power consumption of the fuel pump can be decreased. However, the efficiency of the fuel pump decreases.

It is required to further enhance atomization of fuel, which is injected from fuel injection valves, in order to reduce unburned component in exhaust gas emitted from an engine or in order to facilitate engine start in a low temperature condition or a high temperature condition. In order to enhance atomization of fuel, it is conceived effective that, for example, increasing pressure of fuel supplied to the engine, not only improving fuel injection valves such as a shape of an injection nozzle thereof. In JP-A-5-39763 and JP-A-7-293397, pressure of fuel supplied to fuel injection valves can be increased by jumbo-sized the fuel pump to enhance discharge pressure of the fuel pump. However, when the fuel pump is jumbo-sized, electricity consumption becomes large, and efficiency of the fuel pump decreases.

As disclosed in JP-A-2003-293883, when two fuel pumps are connected in series, pressure of fuel supplied to the engine can be enhanced without jumbo-sized the fuel pump. Thus, the fuel pumps need not be jumbo-sized by driving both the two fuel pumps connected in series. However, even in this structure, electricity consumption becomes large, and efficiency of the fuel pump decreases in each of the fuel pumps.

SUMMARY OF THE INVENTION

The present invention addresses the above disadvantage. According to one aspect of the present invention, a fluid apparatus is provided for supplying fluid into a fluid-receiving device. The fluid apparatus includes an upstream pump, which is electrically driven, having an outlet port. The fluid apparatus further includes a downstream pump, which is electrically driven, having an inlet port that is connected with the outlet port in series. The fluid apparatus further includes an open-close unit. The open-close unit communicates a fluid passage, through which the upstream pump supplies fluid to the fluid-receiving device, when the downstream pump stops. The open-close unit blocks the fluid passage when the downstream pump operates.

According to another aspect of the present invention, a method for controlling a fluid apparatus, which includes an upstream pump and a downstream pump connected in series for supplying fuel to a fuel rail of an internal combustion engine, includes starting the upstream pump. The method further includes starting the downstream pump in accordance with an operating condition of the internal combustion engine so as to increase pressure of fuel in the fuel rail. The method further includes blocking a fuel passage, via which the upstream pump directly is connected with the fuel rail, when the downstream pump is started. The method further includes stopping the downstream pump in accordance with the operating condition of the internal combustion engine so as to decrease pressure of fuel in the fuel rail. The method further includes communicating the fuel passage so as to supply fuel from the upstream pump directly to the fuel rail when the downstream pump is stopped.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
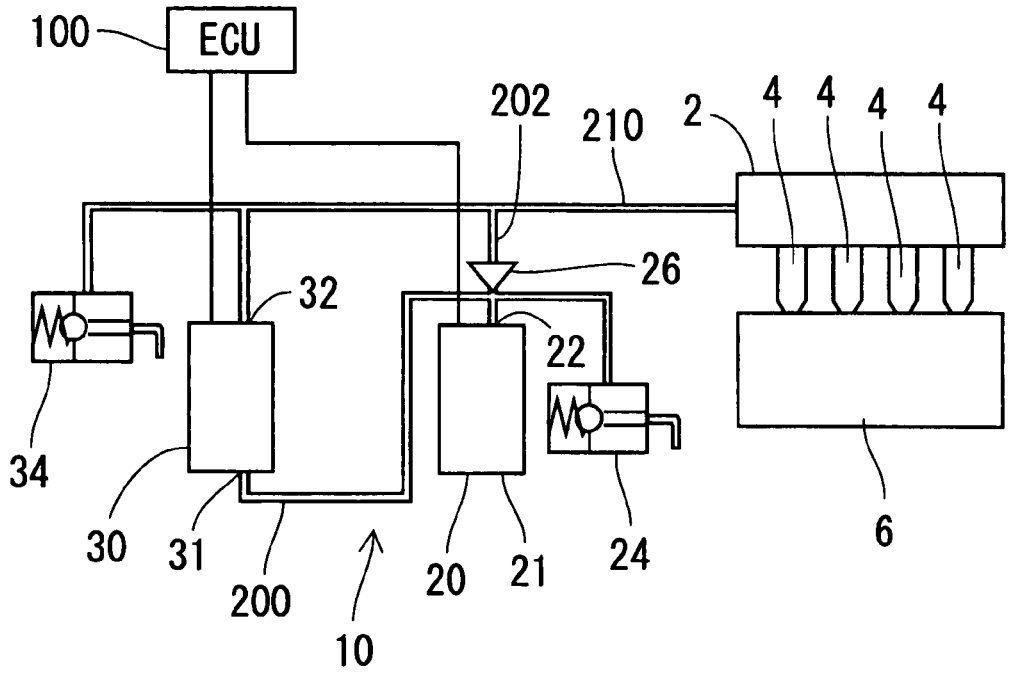
FIG. 1 is a schematic view showing a fluid apparatus provided to an internal combustion engine, according to a first embodiment.

In this embodiment, as shown in FIG. 1, a fluid apparatus 10 is provided to an internal combustion engine (fluid-receiving device) 6 such that the fluid apparatus 10 serves as a fuel feed apparatus to supply fuel from a fuel tank (not shown) into a fuel rail 2. The fuel rail 2 is connected with fuel injection valves 4 each being provided to a corresponding cylinder of the internal combustion engine 6.

The fluid apparatus 10 includes, two fuel pumps 20, 30 that are accommodated in the fuel tank. The fuel pump (upstream fuel pump) 20 has an outlet port 22 connected with an inlet port 31 of the fuel pump (downstream fuel pump) 30 through a pipe 200, so that the fuel pumps 20, 30 are connected in series. Each of the fuel pumps 20, 30 is, for example, an electric turbine pump that includes an electric motor for rotating an impeller to pump fuel.

The upstream fuel pump 20 draws fuel through the inlet port 21, pressurizes the drawn fuel, and discharges the pressurized fuel through the outlet port 22. A pressure regulator 24 is provided for controlling pressure of fuel discharged from the upstream fuel pump 20. The pressure regulator 24 serves as a pressure control unit. The downstream fuel pump 30 is connected to the downstream of the upstream fuel pump 20. The upstream fuel pump 20 discharges fuel, and the pressure regulator 24 controls the discharged fuel in pressure, so that the downstream fuel pump 30 draws the pressure-controlled fuel through the inlet port 31. The downstream fuel pump 30 pressurizes the drawn fuel, thereby discharging the pressurized fuel through the outlet port 32. A pressure regulator 34 is provided for controlling pressure of the fuel discharged from the downstream fuel pump 30. The pressure regulator 24 serves as a pressure control unit. Set pressure of the pressure regulator 34 is greater than set pressure of the pressure regulator 24.

A pipe 210 is provided to connect the outlet port 32 of the downstream fuel pump 30 with the fuel rail 2. The pipe 200 connects with the pipe 210 through a pipe 202. A check valve 26 is provided to the pipe 202. The check valve 26 serves as an open-close unit. The check valve 26 permits flowing of fuel from the pipe 200 on a discharge side of the upstream fuel pump 20 toward the pipe 210 on the side of the engine 6. The check valve 26 regulates flowing of fuel from the pipe 210 to the pipe 200. The check valve 26 is, for example, a generally known mechanical valve that includes a spring applying force to a ball in a direction to regulate flowing of fuel from the pipe 210 to the pipe 200.

An engine control unit (ECU ) 100 is constructed of a CPU, a ROM, and a RAM (nor shown). The ECU 100 serves as a control unit. In the ECU 100, the CPU executes a program stored in the ROM, thereby turning electricity, which is supplied to the downstream fuel pump 30, ON and OFF in accordance with the operating condition of the engine 6. That is, the ECU 100 starts and stops the downstream fuel pump 30 in accordance with the operating condition of the engine 6. The ECU 100 turns the electricity supplied to the upstream fuel pump 20 ON in a period between starting and stopping of the engine 6. That is, the ECU 100 regularly operates the upstream fuel pump 20.

Next, a relationship between operating conditions of the fuel pumps 20, 30 and pressure of fuel supplied from the fluid apparatus 10 to the fuel rail 2 is described.

As described above, the ECU 100 turns electricity of the upstream fuel pump 20 ON from starting of the engine 6 to stopping the engine 6, so that the ECU 100 regularly operates the upstream fuel pump 20.

The ECU 100 turns electricity of the downstream fuel pump 30 OFF to stop the downstream fuel pump 30, in the condition where the upstream fuel pump 20 is operated, so that the check valve 26 is opened by being applied with the discharge pressure of the upstream fuel pump 20, and the check valve 26 communicates the pipe 202 therein. The pressure regulator 24 controls pressure of fuel discharged from the upstream fuel pump 20. The pressure-controlled fuel is supplied from the check valve 26 to the fuel rail 2 through the pipes 202, 210.

The ECU 100 turns electricity of the downstream fuel pump 30 ON to start the downstream fuel pump 30, in the condition where the upstream fuel pump 20 is operated, so that the downstream fuel pump 30 draws fuel, which is discharged from the upstream fuel pump 20 and pressure-controlled by the pressure regulator 24, through the pipe 200 and the inlet port 31. The downstream fuel pump 30 pressurizes fuel, which is drawn through the inlet port 31, and discharges the pressurized fuel through the outlet port 32. The downstream fuel pump 30 further pressurizes fuel, which is pressurized by the upstream fuel pump 20, so that discharge pressure of the downstream fuel pump 30 becomes higher than discharge pressure of the upstream fuel pump 20. The pressure regulator 34 controls pressure of the fuel discharged from the downstream fuel pump 30. The set pressure of the pressure regulator 34 is higher than the set pressure of the pressure regulator 24 by, for example, setting spring force high in the pressure regulator 34. Thus, the downstream fuel pump 30 supplies fuel, which is higher than the upstream fuel pump 20 in discharge pressure, to the fuel rail 2 through the pipe 210.

When the downstream fuel pump 30 discharges fuel, the check valve 26 is closed by being applied with pressure difference between discharge pressure of the upstream fuel pump 20 and discharge pressure of the downstream fuel pump 30, so that the check valve 26 blocks the pipe 202 therein. In this condition, fuel discharged from the upstream fuel pump 20 is not supplied directly to the pipe 210.

Figure 2:
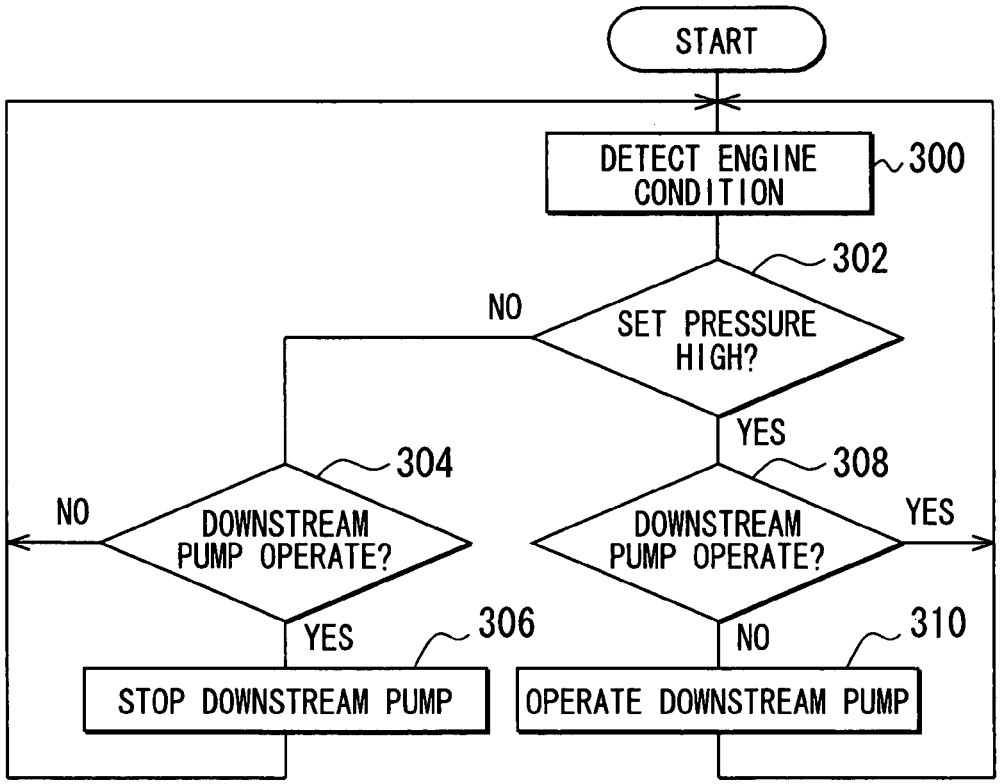
FIG. 2 is a flowchart showing an operation of a downstream fuel pump of the fluid apparatus in accordance with an operating condition of the engine.
Figure 3:
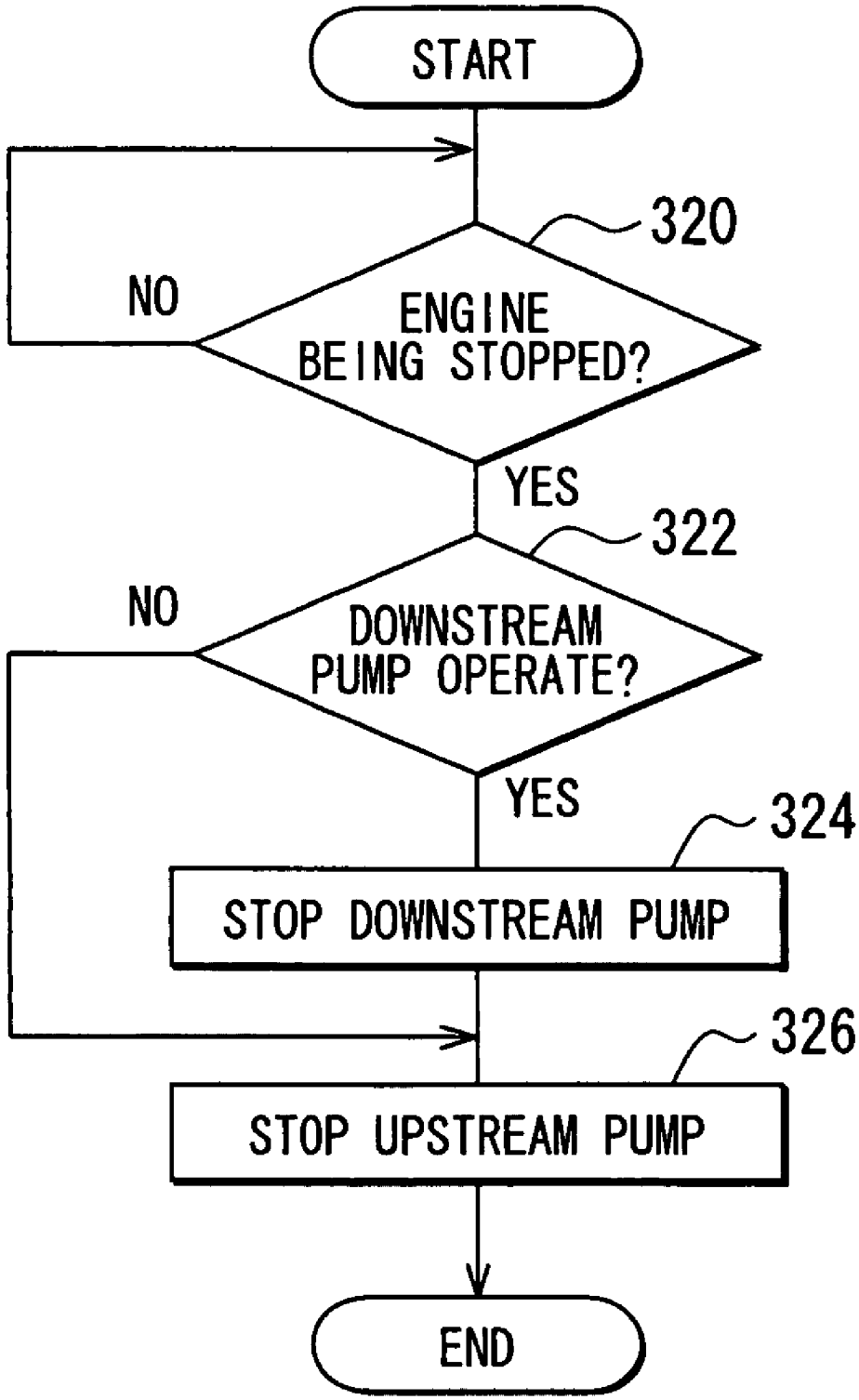
FIG. 3 is a flowchart showing an operation of the downstream fuel pump when the engine is stopped.

Next, an operation of the fluid apparatus 10 is further described in reference to FIGS. 2, 3. Specifically, the CPU of the ECU 100 executes control programs stored in the ROM of the ECU 100, thereby executing the routines shown by FIGS. 2, 3.

As referred to FIG. 2, in step 300, the ECU 100 detects the operating condition of the engine 6, so that the ECU 100 sets pressure of fuel injected from the fuel injection valves 4 at either high pressure or low pressure, in accordance with the detected operating condition of the engine 6. For example, when the engine 6 is started, pressure of fuel supplied to the fuel injection valves 4 is preferably set high, for accelerating atomization of fuel in a low temperature condition, and for both accelerating atomization of fuel and regulating generation of vapor in fuel in a high temperature condition. Alternatively, pressure of fuel supplied to the fuel injection valves 4 may be set low when the engine 6 is imposed with low load in a condition such as constant cruising of the vehicle.

In step 302, the ECU 100 evaluates whether the set pressure of fuel is high or low. When the set pressure is low, the step 302 makes a negative determination, and the routine proceeds to step 304 in which the ECU 100 evaluates whether the downstream fuel pump 30 operates, i.e., runs. When the set pressure is low in step 302, and the ECU 100 turns electricity OFF to stop the downstream fuel pump 30 in step 304, the routine returns the routine to step 300. When the set pressure is low in step 302, and the ECU 100 turns electricity ON to operate the downstream fuel pump 30 in step 304, step 304 makes a positive determination, so that the routine proceeds to step 306. In step 306, the ECU 100 turns electricity OFF to stop the downstream fuel pump 30 so as to decrease pressure of fuel supplied from the fluid apparatus 10 to the fuel rail 2. Thus, the routine returns to step 300.

When the set pressure is high in step 302, the step 302 makes a positive determination, and the routine proceeds to step 308 in which the ECU 100 evaluates whether the downstream fuel pump 30 operates. When the set pressure is high in step 302, and the ECU 100 turns electricity ON to operate the downstream fuel pump 30 in step 308, the routine returns to step 300. When the set pressure is high in step 302 and the ECU 100 turns electricity OFF to stop the downstream fuel pump 30 in step 308, step 308 makes a negative determination, so that the routine proceeds to step 310. In step 310, the ECU 100 turns electricity ON to operate the downstream fuel pump 30 so as to increase pressure of fuel supplied from the fluid apparatus 10 to the fuel rail 2. Thus, the routine returns to step 300.

In these operations, the ECU 100 turns electricity of the downstream fuel pump 30 ON and OFF, in accordance with the operating condition of the engine 6. When the engine 6 requires high pressure fuel, the ECU 100 turns electricity of the downstream fuel pump 30 ON. When the engine 6 does not require high pressure fuel, the ECU 100 turns electricity of the downstream fuel pump 30 OFF. Thus, electricity consumption of the fluid apparatus 10 can be reduced compared with a structure in which the fuel pumps 20, 30 are regularly operated.

Furthermore, the ECU 100 applies constant maximum voltage to each of the fuel pumps 20, 30, instead of variably controlling voltage applied to each of the fuel pumps 20, 30. The efficiency of each of the fuel pumps 20, 30 can be maintained substantially optimum by applying the maximum voltage to each of the fuel pumps 20, 30. Therefore, the efficiency of each of the fuel pumps 20, 30 can be enhanced compared with variably controlling the voltage applied to each of the fuel pumps 20, 30.

Next, operations of the fuel pumps 20, 30 in stopping the engine 6 are described in reference to FIG. 3.

In step 320, the ECU 100 evaluates whether the engine 6 is being stopped. When the engine 6 is being stopped, the step 320 makes a positive determination, and the routine proceeds to step 322 in which the ECU 100 evaluates whether the downstream fuel pump 30 operates.

When the engine 6 is being stopped in step 320 and the ECU 100 turns electricity ON to operate the downstream fuel pump 30, step 322 makes a positive determination, so that the routine proceeds to step 324. In step 324, the ECU 100 turns electricity OFF to stop the downstream fuel pump 30. When the downstream fuel pump 30 stops, the check valve 26 is opened by being applied with discharge pressure of the upstream fuel pump 20. Consequently, fuel discharged from the upstream fuel pump 20 is supplied directly to the fuel rail 2, so that pressure of fuel in the fuel rail 2 decreases. The ECU 100 waits for a predetermined period after turning electricity of the downstream fuel pump 30 OFF. Subsequently, the routine proceeds to step 326 after elapsing the predetermined period. In step 326, the ECU 100 turns electricity OFF to stop the upstream fuel pump 20.

When the engine 6 is being stopped in step 320 and the ECU 100 already turns electricity OFF to stop the downstream fuel pump 30 in step 322, the routine proceeds to step 326. In step 326, the ECU 100 turns electricity OFF to stop the upstream fuel pump 20.

In these operations, when the engine 6 is being stopped and both the fuel pumps 20, 30 are operated, the ECU 100 stops the downstream fuel pump 30 prior to stopping the upstream fuel pump 20. Thus, pressure of fuel supplied to the fuel rail 2 is beforehand decreased, so that pressure of fuel in the fuel rail 2 is set low when the engine 6 stops. Therefore, pressure in the fuel rail 2 can be regulated, so that fuel can be restricted from leaking through the fuel injection valves 4, when the engine 6 is being stopped.

Furthermore, in this embodiment, when the downstream fuel pump 30 operates, the check valve 26 blocks the pipe 202 through which the upstream fuel pump 20 directly connects with the fuel rail 2. Alternatively, when the downstream fuel pump 30 stops, the check valve 26 communicates the pipe 202, 50 that the upstream fuel pump 20 directly supplies fuel into the fuel rail 2 through the pipe 202. In this configuration, the open-close unit can be produced with the check valve 26 having a simple structure.

Second Embodiment

Figure 4:
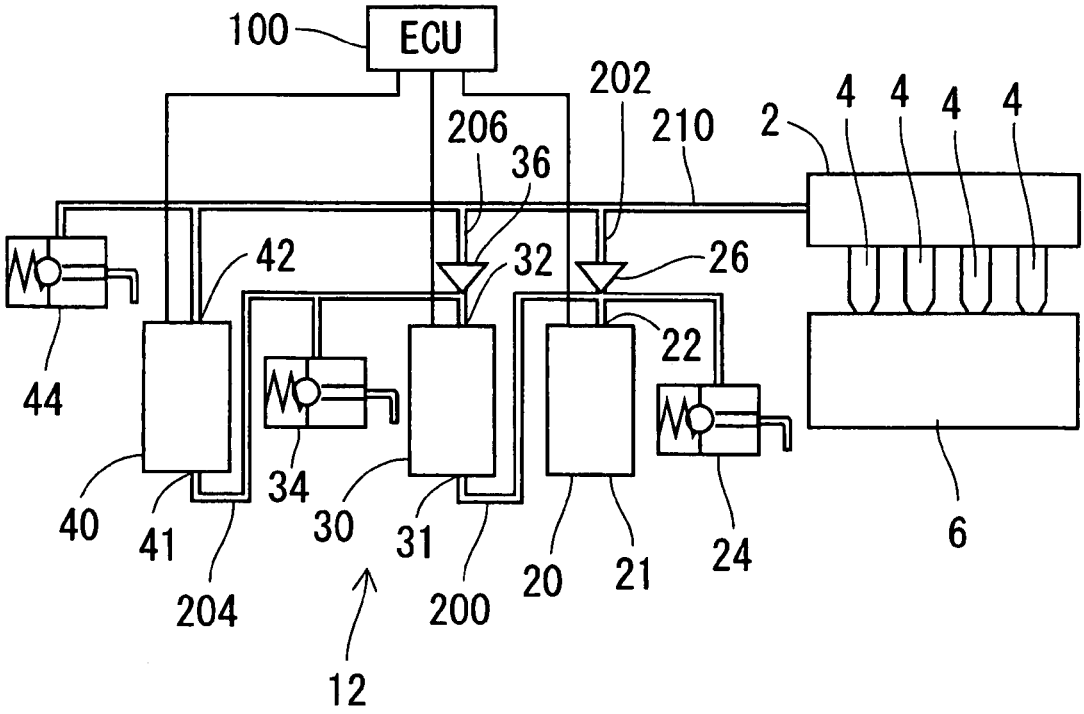
FIG. 4 is a schematic view showing a fluid apparatus according to a second embodiment.

As shown in FIG. 4, in a fluid apparatus 12 of this embodiment, the pipe 200 is provided to communicate the outlet port 22 with the inlet port 31. A pipe 204 is further provided to communicate the outlet port 32 with an inlet port 41. In this structure, three fuel pumps 20, 30, 40 are connected in series in this order from the upstream. The downmost stream fuel pump 40 has an outlet port 42 through which the downmost stream fuel pump 40 is connected with the pipe 210. A check valve 36 is further provided to a pipe 206 that connects the pipe 204 with the pipe 210. The check valve 36 communicates and blocks the pipe 206 therein in accordance with pressure difference between the pipe 204 and the pipe 210. First set pressure of a pressure regulator 44 is determined to be greater than second set pressure of the pressure regulator 34. The second set pressure of the pressure regulator 34 is determined to be greater than third set pressure of the pressure regulator 24. That is, first set pressure>second set pressure>third set pressure.

When the uppermost stream fuel pump 20 operates and the downstream fuel pumps 30, 40 stop, the check valve 26 opens and the check valve 36 closes. In this condition, fuel, which is discharged from the fuel pump 20 and pressure-controlled by the pressure regulator 24, is supplied directly to the fuel rail 2 through the check valve 26.

When the fuel pumps 20, 30 operate and the downmost stream fuel pump 40 stop, the check valve 26 is closed by being applied with pressure difference between discharge pressure of the uppermost stream fuel pump 20 and discharge pressure of the middlestream fuel pump 30. In this condition, the check valve 36 opens, so that fuel, which is discharged from the middlestream fuel pump 30 and pressure-controlled by the pressure regulator 34, is supplied to the fuel rail 2.

When all the fuel pumps 20, 30, 40 operate, the check valves 26, 36 are closed by being applied with pressure difference between discharge pressure of the fuel pumps 20, 30, 40. In this condition, fuel, which is discharged from the downmost stream fuel pump 40 and pressure-controlled by the pressure regulator 44, is supplied to the fuel rail 2. The pressure regulator 44 serves as a pressure control unit.

When the engine 6 is being stopped, pressure in the fuel rail 2 can be decreased by stopping from the downmost stream fuel pump 40 to the fuel pumps 30, 20 in this order, similarly to the first embodiment.

Third Embodiment

In the fluid apparatus 10 of the first embodiment, when the engine 6 stops, high pressure in the fuel rail 2 is applied directly to the downstream fuel pump 30. In this condition, fuel may slightly leak from the fuel rail 2 to the downstream of the fuel rail 2 through the downstream fuel pump 30, when the downstream fuel pump 30 does not have sufficient blockade performance to restrict fuel from reverse flowing. As a result, pressure in the fuel rail 2 decreases when the engine 6 stops.

Figure 5:
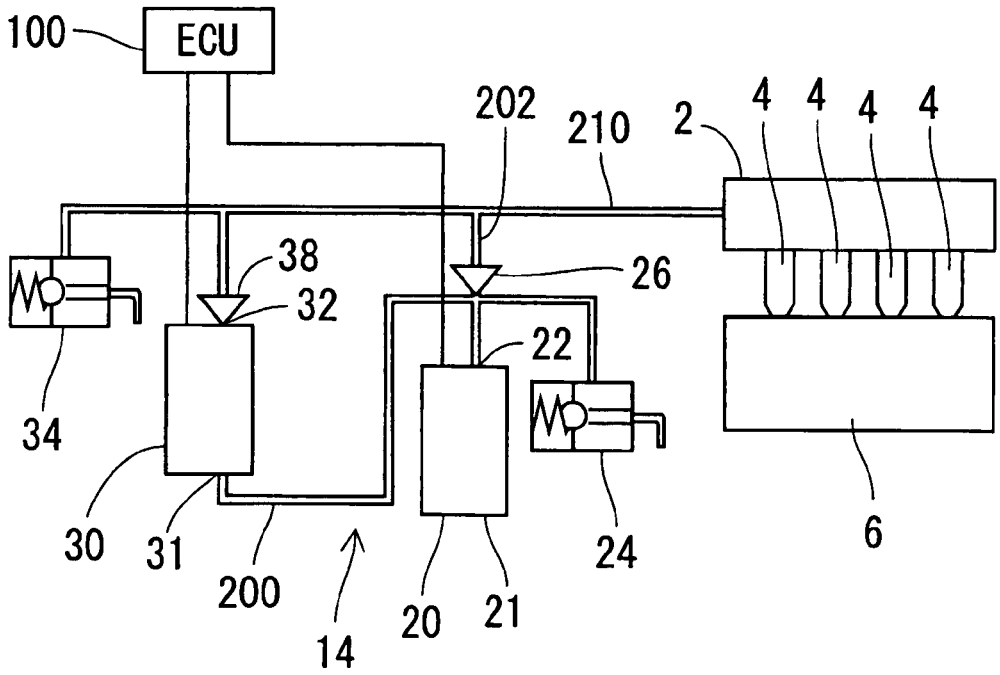
FIG. 5 is a schematic view showing a fluid apparatus according to a third embodiment.

By contrast, as shown in FIG. 5, in a fluid apparatus 14 of this third embodiment, a check valve 38 is provided in the vicinity of the outlet port 32 of the downstream fuel pump 30, in addition to the fluid apparatus 10 of the first embodiment. The check valve 38 opens when fuel flows from the downstream fuel pump 30 to the fuel rail 2. The check valve 38 blocks flowing of fuel from the fuel rail 2 to the downstream fuel pump 30.

In the fluid apparatus 14 of this third embodiment, even when fuel leaks in the downstream fuel pump 30, the check valve 38 restricts further leakage of fuel from the fuel rail 2. In addition, the check valve 26, which serves as an open-close unit, is capable of restricting fuel from reverse flowing from the fuel rail 2 when the engine 6 stops. Thus, even when the fuel pumps 20, 30 do not have sufficient blockade performance, the check valves 26, 38 are capable of maintaining pressure of fuel in the fuel rail 2 in the condition where the engine 6 stops.

In the above embodiments, multiple fuel pumps are connected in series, so that the discharge pressure can be enhanced from the upstream fuel pump to the downstream fuel pump. Therefore, pressure of fuel supplied to the engine can be enhanced substantially without jumbo-sizing each fuel pump.

Furthermore, the downstream fuel pump is turned ON and OFF in accordance with the operating condition of the engine, so that power consumption of the fluid apparatus, which includes the fuel pumps connected in series, can be reduced.

Other Embodiment

In the above embodiments, two or three fuel pumps are connected in series. Alternatively, four or more fuel pumps may be connected in series.

In the above embodiments, the open-close unit is constructed of the check valve. When the downstream fuel pump operates, the check valve 26, 36 blocks the pipe through which the fuel pump in the upstream of the operating fuel pump directly connects with the fuel rail 2. When the downstream fuel pump stops, the check valve 26, 36 communicates the pipe through which the fuel pump in the upstream of the stopping fuel pump supplies fuel to the fuel rail 2. The check valve serves as the open-close unit, so that the open-close unit can be produced with a simple structure, and the open-close unit need not be controlled. Thus, the fluid apparatus can be smallsized and simplified compared with providing an electrically controlled valve manipulated using a controller such as the ECU 100. For example, a three-way valve may be provided to the connection between the fuel pumps, so as to serve as an open-close unit, and the ECU 100 may control to switch the three way valve.

In the above embodiments, the pressure regulator controls the discharge pressure of each pump. Alternatively, the pressure regulator need not control the discharge pressure of each pump. Fuel discharged from the fuel pump may be supplied directly to the fuel rail 2.

The above processings such as calculations and determinations are not limited being executed by the ECU 100. The control unit may have various structures and combinations including the ECU 100 shown as an example.

The above structures of the embodiments can be combined as appropriate. In the above embodiments, the fluid apparatus is used for supplying fuel to an engine. However, the fluid apparatus is not limited to application to an engine. Fluid is not limited to fuel. The feed apparatus can be used for any other hydraulic system for enhancing energy consumption and pump efficiency by providing multiple pumps.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel feed apparatus for supplying fuel to an internal combustion engine, the fuel feed apparatus comprising:

an upstream pump having an outlet port via which the upstream pump is connected with the internal combustion engine through a fluid passage;

a downstream pump having an inlet port via which the downstream pump is connected with the outlet port in series;

an open-close unit configured to block the fluid passage when the downstream pump operates; and a control unit for controlling at least one of the upstream pump, the downstream pump, and the open-close unit, wherein the control unit is configured to stop the downstream pump in response to a condition where the internal combustion engine is being stopped, and the open-close unit is configured to open the fluid passage to communicate the upstream pump directly with the internal combustion engine in response to stoppage of the downstream pump.

2. The fuel feed apparatus according to claim 1, wherein the open-close unit is a check valve configured to block the fluid passage by being applied with pressure difference between discharge pressure of the downstream pump and discharge pressure of the upstream pump when the downstream pump operates.

3. The fuel feed apparatus according to claim 1, further comprising:

a pressure control unit for controlling discharge pressure of each of the upstream pump and the downstream pump.

4. The fluid apparatus according to claim 1, wherein the control unit is configured to stop the upstream pump after a predetermined period elapses subsequent to the stopping of the downstream pump.

5. The fluid apparatus according to claim 1, wherein the control unit is configured to stop the upstream pump in response to stoppage of both the internal combustion engine and the downstream pump.

6. The fluid apparatus according to claim 2, wherein the open-close unit is configured to open the fluid passage by being applied with discharge pressure of the upstream pump when the downstream pump stops.

7. A method for controlling a fuel feed apparatus configured to supply fuel to a fuel rail of an internal combustion engine, the method comprising:

starting an upstream pump;

starting a downstream pump, which is connected with the upstream pump in series, in accordance with an operating condition of the internal combustion engine so as to further increase pressure supplied from the upstream pump;

blocking a fuel passage, via which the upstream pump is directly connected with the fuel rail in response to the starting of the downstream pump;

stopping the downstream pump to decrease pressure in the fuel rail in response to a condition where the internal combustion engine is being stopped; and communicating the upstream pump directly with the fuel rail through the fuel passage in response to the stopping of the downstream pump.

8. The method according to claim 7, further comprising:

applying pressure difference between discharge pressure of the downstream pump and discharge pressure of the upstream pump to a check valve, which is provided to the fuel passage so as to control communication in the fuel passage.

9. The method according to claim 7, further comprising:

stopping the upstream pump after elasing a predetermined period subsequent to the stopping of the downstream pump.

10. The method according to claim 7, further comprising:

stopping the upstream pump in response to stoppage of both the internal combustion engine and the downstream pump.

* * * * *